US007549899B2

(12) United States Patent
Imanishi et al.

(10) Patent No.: US 7,549,899 B2
(45) Date of Patent: Jun. 23, 2009

(54) ELECTROMAGNETIC SWITCH OF STARTER

(75) Inventors: Tomoya Imanishi, Kariya (JP); Youichi Hasegawa, Kasugai (JP)

(73) Assignee: Denso Corporation, Kariya (JP)

( * ) Notice: Subject to any disclaimer, the term of this patent is extended or adjusted under 35 U.S.C. 154(b) by 66 days.

(21) Appl. No.: 11/585,118

(22) Filed: Oct. 24, 2006

(65) Prior Publication Data

US 2007/0103265 A1 May 10, 2007

(30) Foreign Application Priority Data

Nov. 9, 2005 (JP) ..... 2005-324720

(51) Int. Cl.
*H01R 4/02* (2006.01)
*H01R 4/10* (2006.01)
*H01H 67/02* (2006.01)

(52) U.S. Cl. ..... 439/877; 439/874; 335/126

(58) Field of Classification Search ..... 335/126, 335/131, 299, 278; 336/192; 439/511, 515, 439/878, 880, 83, 516, 874, 877, 881; 361/668
See application file for complete search history.

(56) References Cited

U.S. PATENT DOCUMENTS 2,472,709 A * 6/1949 Knapp ..... 335/126
3,467,941 A * 9/1969 Martin ..... 439/516
3,571,770 A * 3/1971 Dew ..... 335/256
3,830,346 A * 8/1974 Watts ..... 188/188
4,410,226 A * 10/1983 Adduci et al. ..... 439/142
4,446,505 A * 5/1984 Long et al. ..... 361/785
4,912,448 A * 3/1990 Katayama et al. ..... 336/192
5,021,760 A * 6/1991 Krubsack et al. ..... 335/196
5,097,242 A * 3/1992 Onishi et al. ..... 336/192
5,157,367 A * 10/1992 Itoh et al. ..... 335/126
5,423,117 A * 6/1995 Okada et al. ..... 29/605
5,433,632 A * 7/1995 Cherney et al. ..... 439/495
5,757,256 A * 5/1998 Vilou ..... 335/126
5,801,607 A * 9/1998 Duverger ..... 335/126
6,163,243 A * 12/2000 Titus ..... 336/174
6,633,216 B2 * 10/2003 Lewin et al. ..... 335/220
6,762,663 B2 * 7/2004 Andoh et al. ..... 335/126
6,822,544 B2 * 11/2004 Shiga et al. ..... 335/126
7,038,563 B2 5/2006 Andoh et al.
7,116,196 B1 * 10/2006 Hirabayashi ..... 335/282

(Continued)

FOREIGN PATENT DOCUMENTS

JP B2 3053126 4/2000

(Continued)

*Primary Examiner*—Lincoln Donavan
*Assistant Examiner*—Alexander Talpalatskiy
(74) *Attorney, Agent, or Firm*—Oliff & Berridge, PLC

(57) ABSTRACT

An electromagnetic switch has a solenoid and an electric contact section set to a closed state in response to an attraction force of the solenoid. The contact section is covered with a contact cover fixed to the solenoid, and a terminal electrically connected with the solenoid is placed within the cover. An end of the terminal is protruded from the cover and is electrically connected with a conducting member. The member has a portion joined to the terminal and other portions separated or detachable from the terminal. In the maintenance of the switch, the portion of the member joined to the terminal is removed from the switch. After the maintenance, one of the other portions of the member is joined to the end of the terminal.

8 Claims, 6 Drawing Sheets

U.S. PATENT DOCUMENTS

2001/0006859 A1* 7/2001 Soga et al. ..... 439/516
2002/0145494 A1* 10/2002 Andoh et al. ..... 335/126
2003/0189472 A1* 10/2003 Shiga et al. ..... 335/126
2004/0169573 A1* 9/2004 Andoh et al. ..... 335/126
2006/0109070 A1* 5/2006 Hirabayashi et al. ..... 335/126
2006/0258191 A1* 11/2006 Chen ..... 439/83

FOREIGN PATENT DOCUMENTS

JP 2002-313205 10/2002
JP A 2005-313205 11/2008

* cited by examiner

ELECTROMAGNETIC SWITCH OF STARTER

CROSS-REFERENCE TO RELATED APPLICATION

This application is based upon and claims the benefit of priority of the prior Japanese Patent Application 2005-324720 filed on Nov. 9, 2005 so that the contents of which are incorporated herein by reference.

BACKGROUND OF THE INVENTION

1. Field of the Invention

The present invention relates to an electromagnetic switch of a starter which is turned on in response to a magnetic attraction force generated in an electromagnet to start an operation of an engine.

2. Description of Related Art

A technique for automating assembly of an electromagnetic switch used for a starter has been proposed. in Published Japanese Patent First Publication No. 2002-313205. FIG. 1 is a sectional view showing attachment of a terminal to a conducting plate in an electromagnetic switch disclosed in this Publication.

As shown in FIG. 1, in an electromagnetic switch, a plate-shaped terminal 100 electrically connected with an electromagnetic coil (not shown) is protruded from a contact cover 110. The terminal 100 is joined to a conducting plate 120 on the outside of the cover 110 with solder. The plate 120 is connected with a terminal 130 of a motor (not shown). The motor is earthed. The terminal 130 is covered with the cover 110. When an ignition key (not shown) is turned on, an electric current set at a small value is supplied from a battery (not shown) to the coil and is transmitted to the earthed motor through the terminal 100, the plate 120 and the terminal 130. Therefore, the coil generates a magnetic field in response to the current, and an electric contact section (not shown) is turned on in response to the magnetic field. That is, the switch is turned on. Then, an electric current set at a large value is supplied from the battery to the motor through the electric contact section. Therefore, the motor generates a rotational force, and an operation of an engine of a vehicle (not shown) is started in response to the rotational force.

The cover 110 is disposed so as to protect contact members (not shown) of the switch. The terminal 100 has a stiffness larger than that of a terminal of the coil so as to maintain the shape of the terminal 100 on the outside of the cover 110. With this structure, because the terminal 100 having the stiffness is used to electrically connect the coil with the motor terminal 130, it is not required to extend a terminal of the coil to the outside of the cover 110. Therefore, assembly of an electromagnetic switch including the coil and the cover 110 can be automated.

In cases where the contact members of the switch are changed to new ones to perform maintenance of the switch, portions of the terminal 100 and the plate 120 joined together are cut off, and the cover 110 is taken off from the switch to expose the contact members to the outside of the switch. After the contact members are changed to new ones, the cover 110 is again attached to the switch, and it is tried to again join the terminal 100 and the plate 120 together on the outside of the cover 110.

However, because the joined portions of the terminal 100 and the plate 110 have been already removed, it is difficult to join the terminal 100 and the plate 120 together again on the outside of the cover 110. To join the terminal 100 and the plate 120 together in the maintenance of the switch, it is required to change the terminal 100 and the plate 120 to new ones. Therefore, cost required in the maintenance of the switch is heightened. Further, the coil is wound on a bobbin (not shown), and the terminal 100 is forcibly inserted into the bobbin to be fixed to the bobbin. Therefore, it is difficult to separate the terminal 100 from the bobbin, so that it is required to change both the terminal 100 and bobbin to new ones. Further, the number of work steps required to change parts of the switch is increased. Therefore, not only cost of changed parts is heightened, but also cost for the maintenance work is heightened.

SUMMARY OF THE INVENTION

An object of the present invention is to provide, with due consideration to the drawbacks of the conventional electromagnetic switch, an electromagnetic switch wherein a conducting member connected with a motor terminal is easily joined to a terminal electrically connected with an electromagnetic coil without changing the terminal and the conducting member to new ones in the maintenance of the switch.

According to a first aspect of this invention, the object is achieved by the provision of an electromagnetic switch comprising a solenoid having an electromagnetic coil, a contact cover fitted to the solenoid, an electric contact section covered with the contact cover, a terminal electrically connected with the electromagnetic coil and placed within the contact cover, and a conducting member electrically connected with an end portion of the terminal protruded from the contact cover. The conducting member has a plurality of connecting portions joinable to the end portion of the terminal, one of the connecting portions of the conducting member is joined to the end portion of the terminal, and at least one of the other connecting portions of the conducting member is disposed to be separated or detachable from the terminal.

When the solenoid receives an electric current, the electromagnetic coil acts as an electromagnet, and the solenoid generates an attraction force. The electric contact section is set to a closed state in response to the attraction force, and electric power is transmit through the electric contact section.

In cases where the electric contact section is changed to a new one in the maintenance of the switch, the connecting portion of the conducting member joined to the end portion of the terminal is removed from the conducting member to detach the conducting member from the terminal, and the contact cover is detached from the solenoid while the terminal is drawn out from the contact cover. After the electric contact section is changed to anew one, the contact cover is again fitted to the solenoid while the terminal is inserted into the contact cover, and one of the other connecting portions of the conducting member is joined to the end portion of the terminal.

Accordingly, the conducting member connected with a motor terminal can be easily joined to the terminal electrically connected with the electromagnetic coil without changing the terminal and the conducting member to new ones in the maintenance of the switch.

According to a second aspect of this invention, the end portion of the terminal has a plurality of connecting portions joinable to the conducting member, the conducting member is joined to one of the connecting portions of the terminal, and the conducting member is disposed to be separated or detachable from at least one of the other connecting portions of the terminal.

In case of the maintenance of the switch, the connecting portion of the terminal joined to the conducting member is removed from the terminal to detach the conducting member from the terminal. When the contact cover is again fitted to the solenoid, one of the other connecting portions of the terminal is joined to the conducting member.

Accordingly, the conducting member connected with a motor terminal can be easily joined to the terminal electrically connected with the electromagnetic coil without changing the terminal and the conducting member to new ones in the maintenance of the switch.

DETAILED DESCRIPTION OF THE PREFERRED EMBODIMENTS

Embodiments of the present invention will now be described with reference to the accompanying drawings. However, these embodiments should not be construed as limiting the present invention to structures of those embodiments, and the structure of this invention may be combined with that based on the prior art.

Embodiment 1

Figure 2:
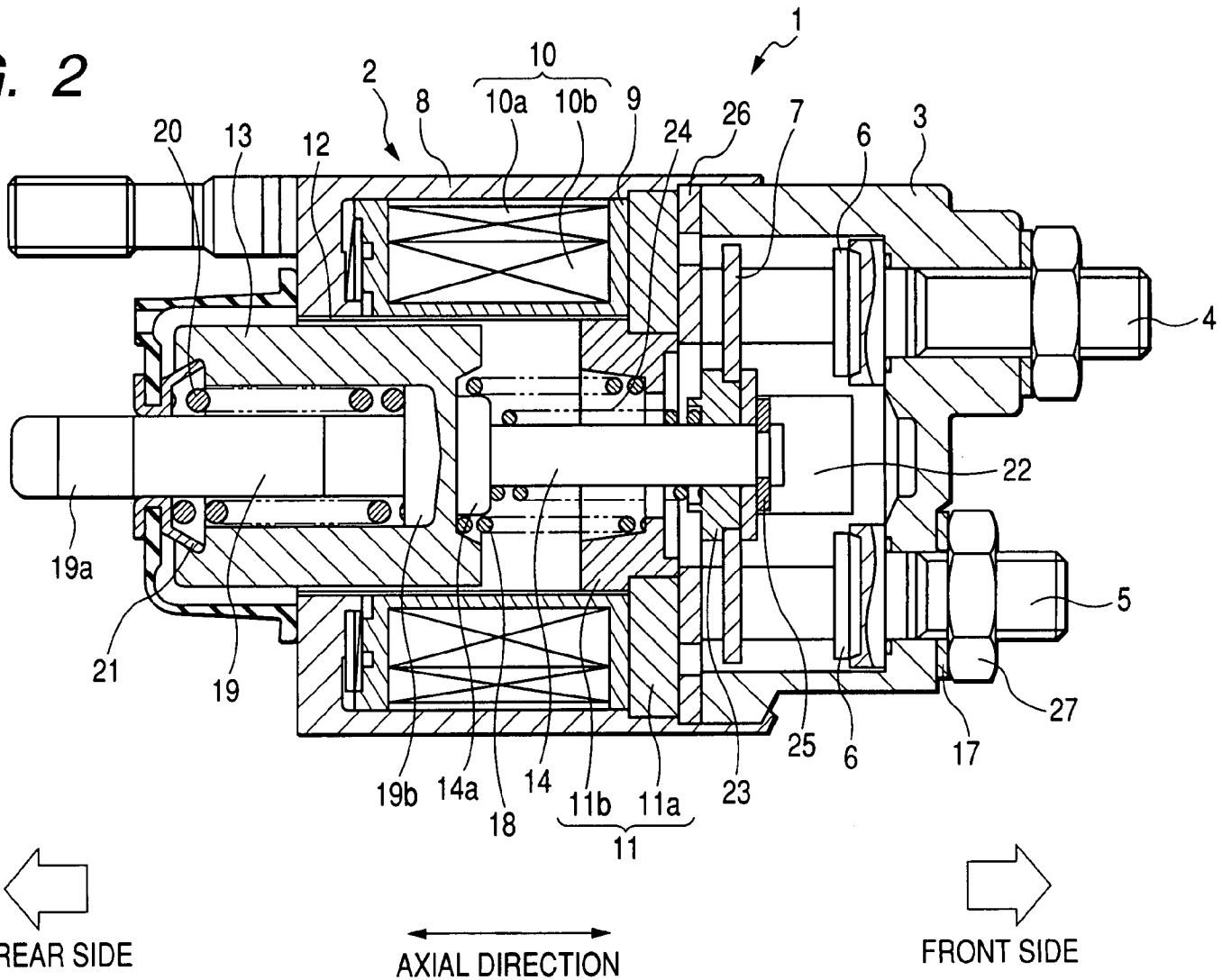
FIG. 2 is a sectional view of an electromagnetic switch of a starter according to embodiments of the present invention.

FIG. 2 is a sectional view of an electromagnetic switch of a starter.

An electromagnetic switch is arranged in a starter (not shown) used to start an operation of an engine of a vehicle, and a main contacting section of the switch connects or disconnects a lead wire of a starting motor with or from a terminal of an onboard battery. As shown in FIG. 2, an electromagnetic switch 1 has a solenoid 2 receiving an electric current to act as an electromagnet and generating an attraction force by using the electromagnet, a contact cover 3 fitted to the solenoid 2, a conducting member 17 electrically connected with the solenoid 2 through a terminal (described later in detail), and an electric contact section having terminals 4 and 5 and contacts 6 and 7. The cover 3 is made of resin, and the electric contact section is surrounded by the cover 3. The section is set to a closed state in response to the attraction force.

The electric contact section has two fixed contacts 6 and a movable contact 7. The contacts 6 are respectively connected with an external terminal 4 and an external terminal 5. The contact 7 connects or disconnects one fixed contact 6 with or from the other fixed contact 6. The terminal 4 is electrically connected with a battery cable of an onboard battery (not shown), and the terminal 5 is electrically connected with a lead wire of a starting motor (not shown). When the contact 7 comes in contact with the contacts 6, electric power of the battery is supplied to the motor through the terminals 4 and 5 and the contacts 6 and 7, and the motor starts generating a rotational force. When the contact 7 is detached from the contacts 6, the motor stops generating the rotational force. Mail thread portions of the terminals 4 and 5 are screwed into the cover 3 and are respectively connected with the contacts 6, and the contacts 6 are disposed in a contact chamber 22 surrounded by the cover 3.

The solenoid 2 has a switch yoke 8 formed in a cup shape, an electromagnetic coil 10 wound around a bobbin 9 and disposed in an open space of the yoke 8, a fixed core 11 disposed on a front side (i.e., right side in FIG. 2) of the coil 10 through the bobbin 8 so as to surround the coil 10 with the yoke 8, a plunger 13 inserted into a central open space of the bobbin 9 through a sleeve 12 along an axial direction of the plunger 13, and a shaft 14 attached to a front end of the plunger 13. The bobbin 9 is made of resin. The yoke 8 acts as a frame of the solenoid 2.

The coil 10 has an attracting coil 10*a* and a holding coil 10*b* wound around the bobbin 9 in two layers. The coil 10 generates a magnetic field in response to an electric current supplied from the battery so as to magnetize the core 11 and the yoke 8. That is, a fixed magnetic circuit is formed around the coil 10. The coil 10*a* generates a magnetic attraction force to pull the plunger 13 toward the core 11. The coil 10*b* generates a magnetic force to hold the plunger 13 being in contact with the core 11.

The core 11 has an outer core 11*a* formed in a cylindrical shape and an inner core 11*b* disposed in a center open space of the core 11*a*. The core 11*a* is disposed on the front side of the yoke 8. The core 11*b* is formed in a cylindrical shape, and the shaft 14 is inserted into an center open space of the core 11*b*. The plunger 13 is disposed to face the core 11*b*. A return spring 18 is disposed between the plunger 13 and the core 11*b* so as to forcibly push the plunger 13 toward a rear side (i.e., left side in FIG. 2) of the switch along the axial direction. A predetermined gap is formed between the plunger 13 and the core 11*b*.

The plunger 13 has an open space on the rear side, and a lever driving rod 19 and a lever spring 20 are inserted into the space of the plunger 13. An engaging groove 19*a* is formed on a surface of an end portion of the rod 19 protruded from the space, and an end of a shift lever (not shown) engages with the groove 19*a* to transmit a rotational force of the motor to an engine through an output shaft (not shown). The spring 20 is disposed between a collar 21 hitched to an end portion of the plunger 13 on the rear side and a cap 19*b* disposed on the other end of the rod 19 so as to surround the rod 19. The spring 20 forcibly pushes the cap 19*b* of the rod 19 against a concave bottom surface of the plunger 13.

The shaft 14 has a flange 14*a* at its end portion, and the flange 14*a* is fixed to a front end of the plunger 13 so as to move the shaft 14 with the plunger 13. The other end portion of the shaft 14 is inserted into a center open space of the core 11*b* and reaches the contact chamber 22. In the chamber 22, the movable contact 7 and the fixed contacts 6 are disposed.

The contact 7 is attached to the end portion of the shaft 14 through an insulator 23. A contact spring 24 is disposed between the flange 14*a* of the shaft 14 and the insulator 23 to forcibly push the contact 7 toward the contacts 6 along the axial. A stopper 25 such as a washer is attached to a top end of the shaft 14 to prevent the contact 7 from being taken off from the top end of the shaft 14. Therefore, the position of the contact 7 on the shaft 14 is fixed by the spring 24 and the stopper 25. A gap length between the contact 7 and the set of contacts 6 is set to be smaller than a gap length between the plunger 13 and the core 11*b*.

An end portion of the contact cover 13 on the rear side is disposed so as to be adjacent to the core 11 through a rubber packing 26, and is fitted to an end portion of the yoke 8 on the front side by caulking so as to form the contact chamber 22 within the cover 13.

The member 17 electrically connected with the coil 10 is fixed on the cover 3 by the terminal 5, so that the member 17 is electrically connected with the motor through the terminal 5.

An operation of the switch 1 is briefly described. When an ignition key (not shown) is entered into a key receiver or a starting button is switch on, an electric current set at a small value is supplied from an onboard battery to the coil 10 and is transmitted to a starting motor (not shown) through the member 17 and the terminal 5. The motor is earthed. Therefore, the coil 10 generates a magnetic field. That is, the coil 10 acts as an electromagnet. The core 11 is magnetized in response to the magnetic field, and a magnetic attraction force is generated between the core 11*b* and the plunger 13. In response to the attraction force, the plunger 13 is moved toward the core 11 while compressing the return spring 18 so as to accumulate a resilient force in the spring 18. The shaft 14 fixed to the plunger 13 is pushed out toward the front side, and the movable contact 13 supported by the shaft 14 comes in contact with the contacts 6. Thereafter, the plunger 13 is further moved toward the core 11 while compressing the contact spring 24 and collides with an end surface of the core 11*b* so as to be stopped. Therefore, a resilient force of the compressed spring 24 is given to the contact 7 so as to forcibly push the contact 7 toward the contacts 6, and the electric contact section is set to a connection state (or closed state). In response to this state, an electric current set at a large value is supplied from the battery to the motor through the contacts 6 and 7 and the terminals 4 and 5 of the electric contact section, so that an operation of the motor is started.

After an operation of an engine of a vehicle is started in response to both the movement of the plunger 13 and a rotational force generated in the motor, the electric current supplied to the coil 10 is automatically stopped, and the attraction force disappears. Therefore, the plunger 13 is pushed back toward the rear side in response to a reaction force of the spring 18, the contact 7 is detached from the contacts 6 so as to set the electric contact section at a disconnection state (or opened state), and power supply to the starting motor is stopped.

Figure 1:
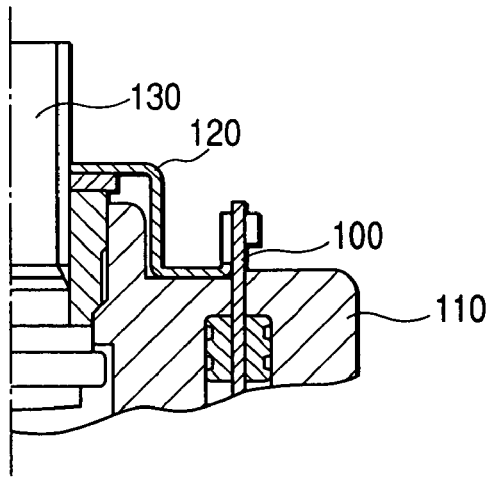
FIG. 1 (PRIOR ART)
FIG. 1 is a sectional view showing assembly of a terminal and a conducting plate according to a prior art.
Figure 3:
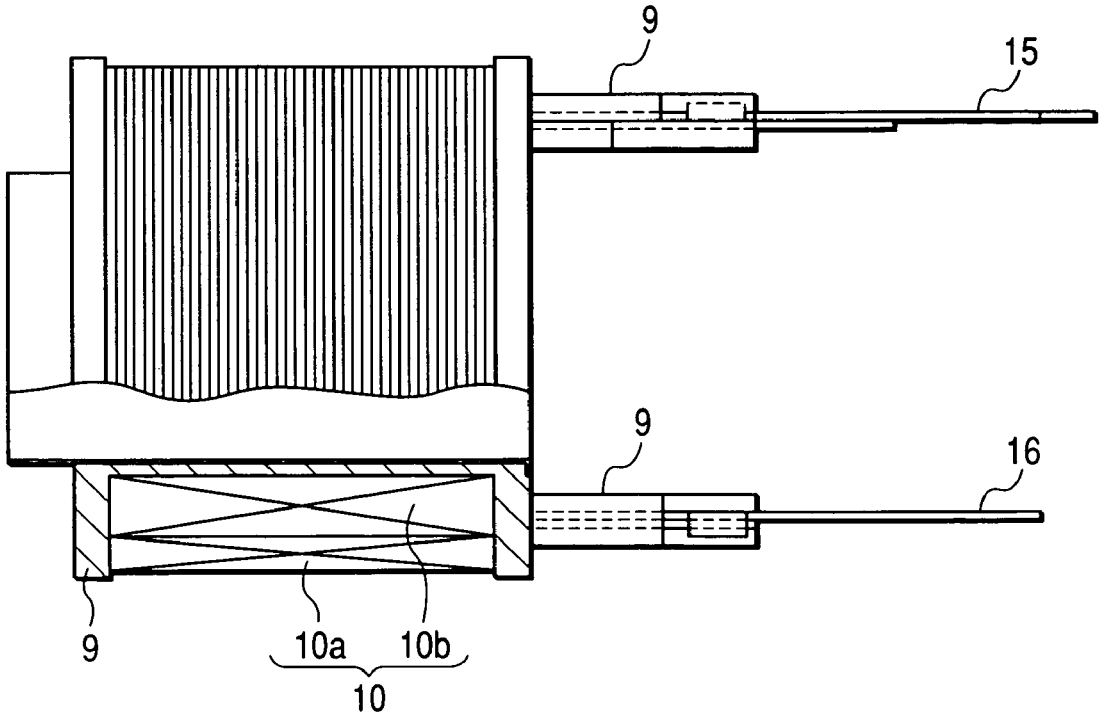
FIG. 3 is a sectional view of an electromagnetic coil wound around a bobbin.
Figure 4:
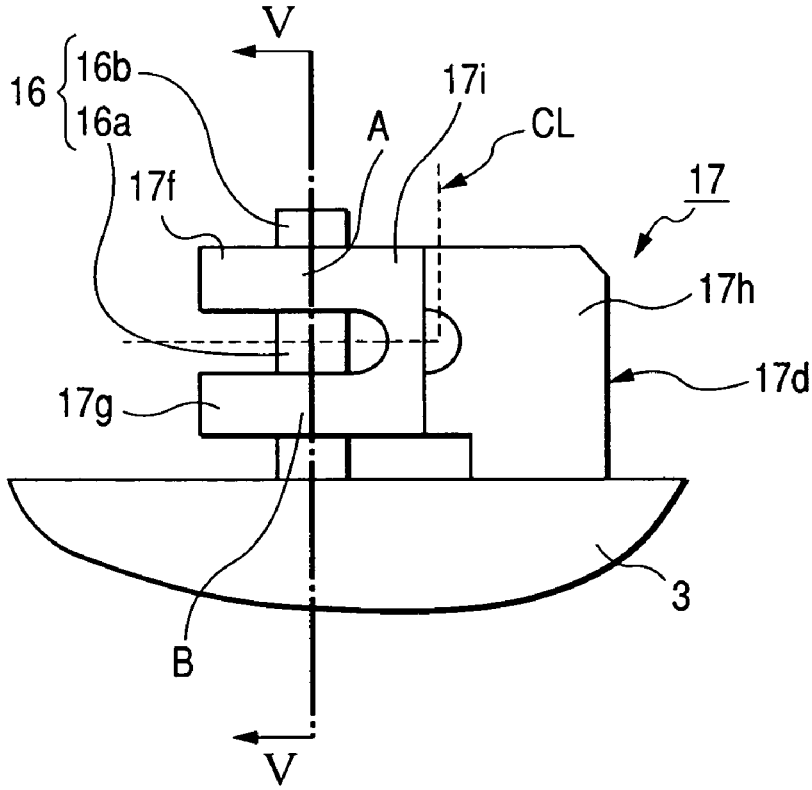
FIG. 4 is a side view of both a terminal and a conductive plate joined together.
Figure 5:
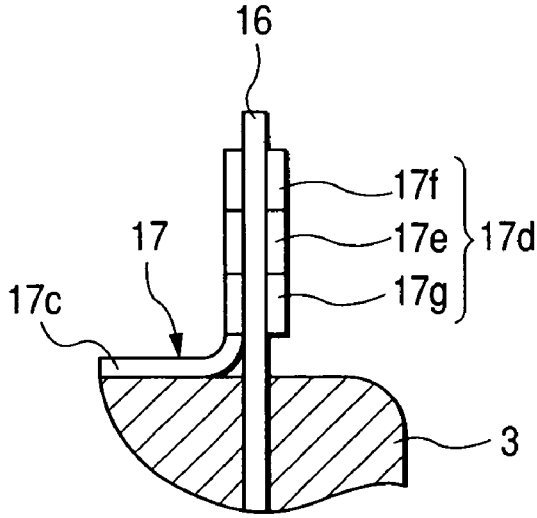
FIG. 5 is a sectional view taken substantially along line V-V of FIG. 4.

Next, the electric connection of the coil 10 with an exciting circuit of the motor is described in detail. FIG. 3 is a sectional view of the coil 10 wound around the bobbin 9. FIG. 4 is a side view of both a terminal and a conductive plate joined together, and FIG. 5 is a sectional view taken substantially along line V-V of FIG. 4.

As shown in FIG. 3, each of end portions of the attracting coil 10*a* and the holding coil 10*b* in the coil 10 is connected with a first end portion of a terminal 15. The other end portion of the coil 10*a* is connected with a first end portion of a terminal 16. The other end portion of the coil 10*b* is electrically connected with a surface of the core 11 by welding and is earthed through the yoke 8. The first end portion of each of the terminals 15 and 16 is pressed into the bobbin 9 so as to be fixed in the bobbin 9. The terminals 15 and 16 are inserted into the contact cover 3, and each of second end portions of the terminals 15 and 16 is protruded from the cover 3. The second end portion of the terminal 15 is connected with a starting switch (not shown) through a lead wire (not shown). As shown in FIG. 4 and FIG. 5, the second end portion of the terminal 16 is formed in a long plate shape or belt-like shape and has predetermined length, thickness and width. The second end portion of the terminal 16 is joined or bonded to the conducting member 17 with solder or by welding and is electrically connected with the terminal 5 through the member 17.

Figure 6:
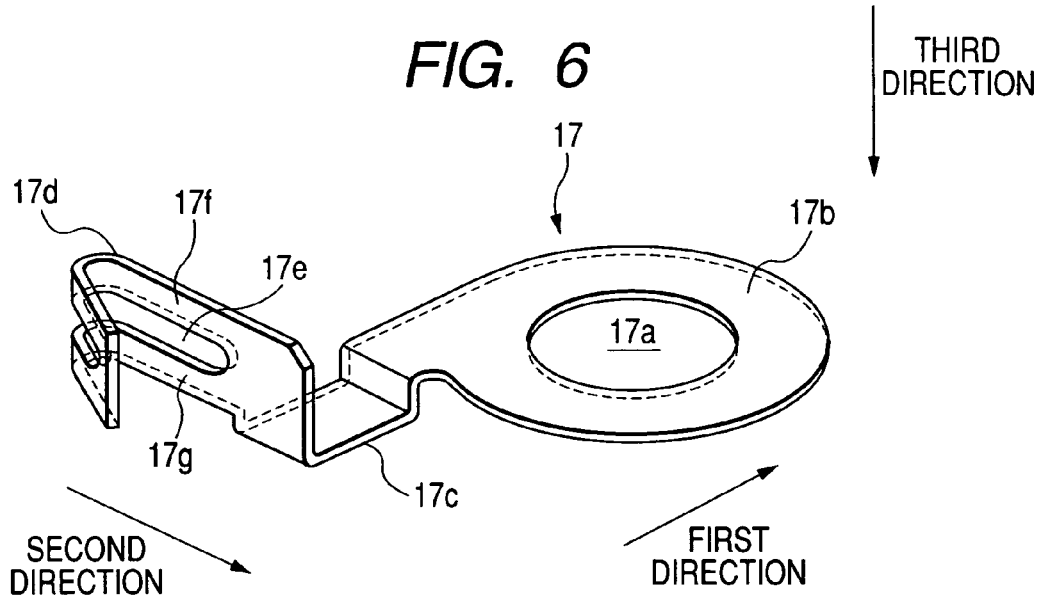
FIG. 6 is a perspective side view of the conductive plate not yet joined to the terminal.
Figure 7B:
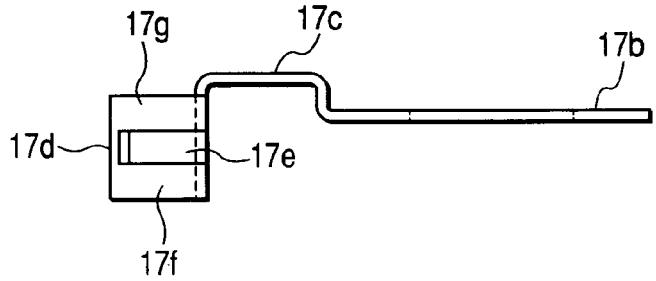
FIG. 7B is a second side view of the conductive plate shown in FIG. 6 when the conductive plate is seen along a second direction.
Figure 7A:
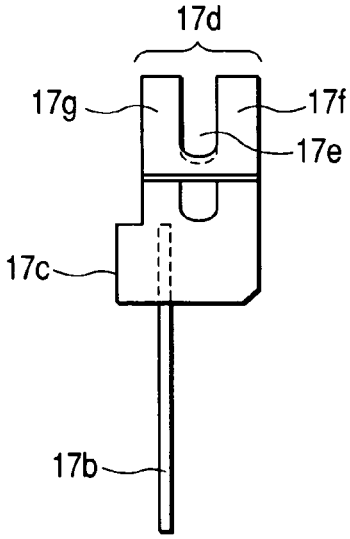
FIG. 7A is a first side view of the conductive plate shown in FIG. 6 when the conductive plate is seen along a first direction.
Figure 7C:
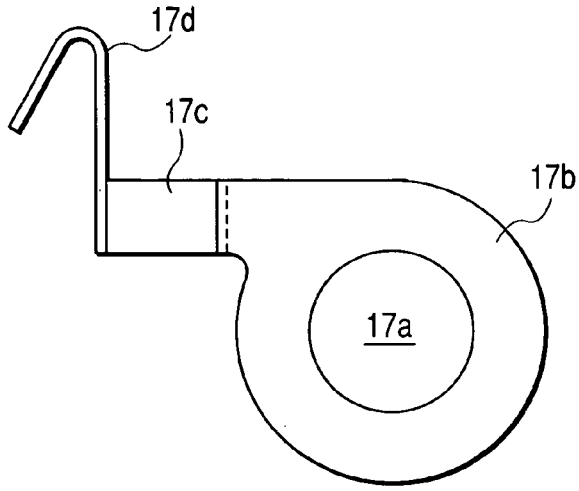
FIG. 7C is a third side view of the conductive plate shown in FIG. 6 when the conductive plate is seen along a third direction.

FIG. 6 is a perspective side view of the conductive plate not yet joined to the terminal. FIG. 7A is a first side view of the conductive plate shown in FIG. 6 when the conductive plate is seen along a first direction, FIG. 7B is a second side view of the conductive plate shown in FIG. 6 when the conductive plate is seen along a second direction, and FIG. 7C is a third side view of the conductive plate shown in FIG. 6 when the conductive plate is seen along a third direction.

As shown in FIG. 6 and FIGS. 7A to 7C, the conducting member 17 is formed by cutting and bending a flat metallic plate made of conductive material. The member 17 has a ring-shaped washer 17*b* extending on a plane defined by first and second directions perpendicular to each other, a contacting plate portion 17*c* extending from the washer 17*b* in a direction opposite to the first direction, and a connecting arm 17*d* extending from the portion 17*c*.

The washer 17*b* has a circular opening 17*a* in its center, and a male thread of the terminal 5 is inserted into the opening 17*a*. The terminal 5 is screwed into the cover 3 while fastening the washer 17*b* between the cover 3 and a nut 27 of the terminal 5. Therefore, the washer 17*b* is fixed to the terminal 5 on the surface of the cover 3.

The portion 17*c* placed between the washer 17*b* and the arm 17*d* is formed in an L shape in section such that a body of the arm 17*d* is held on the surface of the cover 3 when the washer 17*b* is fixed to the terminal 5. The portion 17*c* determines a positional relation between the terminal 16 and the arm 17*d*.

The arm 17*d* is formed in an almost V shape in section before being joined to the terminal 16. The arm 17*d* has a proximal portion 17*h* adjacent to the portion 17*c*, a distal portion 17*i*, and two connecting portions 17*f* and 17*g* disposed between the portions 17*h* and 17*i*. The portions 17*f* and 17*g* face each other through a long and narrow opening 17*e* along a third direction perpendicular to the first and second directions. The arm 17*d* is formed by bending a rectangular plate piece extending from the portion 17*c* at 90 degrees such that the plate piece stands on a plane of the portion 17*c*, and again bending the plate piece at its middle portion in the second direction such that the plate piece is formed in an almost V shape when being seen along the third direction. Therefore, the portions 17*f* and 17*g* are bent in the almost V shape.

As shown in FIG. 4 and FIG. 5, the second end portion of the terminal 16 protruded from the cover 3 has a root portion 16*a* adjacent to the cover 3 and a top portion 16*b* placed at the end of the terminal 16. Before being joined to the terminal 16, the arm 17*d* is disposed such that the portions 17*f* and 17*g* are aligned along an extending direction of the terminal 16. That is, the portion 17*g* is disposed so as to surround the root portion 16*a*, and the portion 17*f* is disposed so as to surround the top portion 16*b*. Then, the distal portion l7*i* is bent toward the proximal portion 17*h* such that the terminal 16 is fixed to the portions 17*f* and 17*g*, and the portion 17*f* and the top portion 16*b* of the terminal 16 are joined or bonded together in a joinable area A with solder or the like. In this case, the portion 17*g* and the root portion 16*a* are not joined together, so that a joinable area B of the portion 17*g* and the root portion 16*a* remains as a non-joined area. Therefore, when the portion 17*g* is deformed so as to be away from the terminal 16, the portion 17*g* is detachable from the terminal 16 without being broken or damaged.

After the switch 1 is operated for a predetermined period of time, it is required to change the contacts 6 and 7 to new ones in the normal maintenance of the switch 1. In this case, as shown in FIG. 4, the portion 17*f* of the arm 17*d* and the top portion 16*b* of the terminal 16 joined together with solder are removed from the switch 1 by cutting off the portion 17*f* and the top portion 16*b* along a cutting line CL. Then, the portion 17*g* is deformed so as to be away from the terminal 16, so that the member 17 having the portion 17*g* is detached from the terminal 16 having the root portion 16*a*. Thereafter, the member 17, the terminals 4 and 5 and the cover 3 are removed from the switch 1 while drawing out the terminal 16 from the cover 3, the contacts 6 and 7 are changed to new ones, and the member 17, the terminals 4 and 5 and the cover 3 are attached to the switch 1 while inserting the terminal 16 into both the cover 3 and an open space surrounded by the portion 17*g*. Thereafter, the portion 17*g* surrounding the root portion 16*a* is bent toward the proximal portion 17*h* such that the portion 16*a* of the terminal 16 is fixed to the portion 17*g*, and the portion 17*g* is joined or bonded to the portion 16*a* in the area B with solder or the like.

Therefore, when the contacts 6 and 7 are changed to new ones, it is not required to change the terminal 16 or the member 17. Accordingly, cost required in the maintenance can be reduced.

Further, because it is not required to change the terminal 16 forcibly inserted into the bobbin 9, it is not required to change the bobbin 9. Therefore, the number of work steps required in maintenance can be reduced. Accordingly, not only cost of changed parts can be reduced, but the maintenance of the switch 1 can be easily performed.

Embodiment 2

Figure 8:
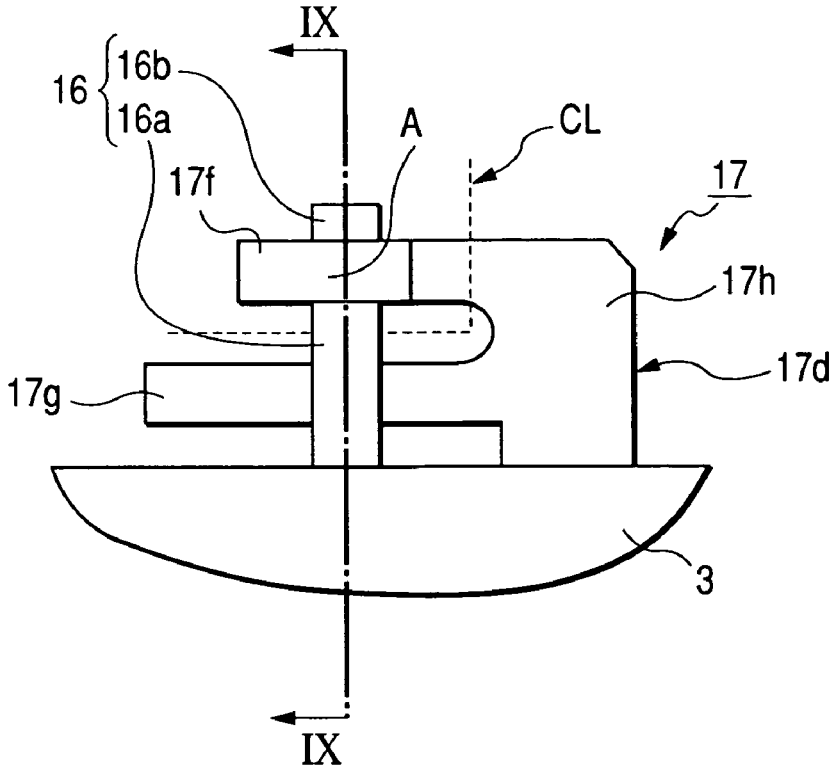
FIG. 8 is a side view of both a terminal and a conductive plate joined together according to the second embodiment.
Figure 9:
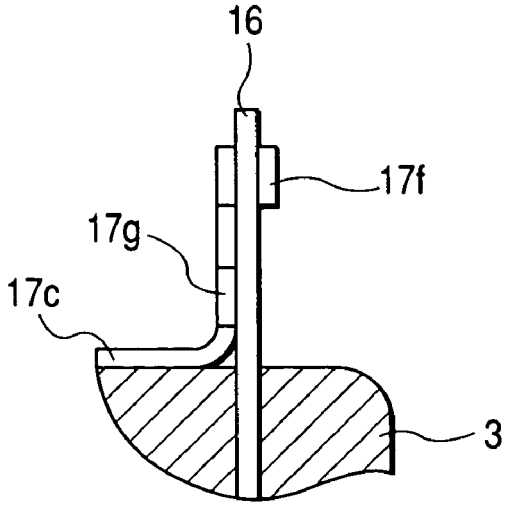
FIG. 9 is a sectional view taken substantially along line IX-IX of FIG. 8.

FIG. 8 is a side view of both a terminal and a conductive plate joined together according to the second embodiment, and FIG. 9 is a sectional view taken substantially along line IX-IX of FIG. 8.

As shown in FIGS. 8 and 9, although the connecting portion 17*f* is turned back and joined to the top portion 16*b* at the joinable area A with solder, the connecting portion 17*g* is straightly extended and is in contact with the root portion 16*a* of the terminal 16. Therefore, a joinable area C of the portions 17*g* and 16*a* remains as a non-joined area.

When it is intended to change the contacts 6 and 7 to new ones in the normal maintenance of the switch 1, the top portion 16*b* and the connecting portion 17*f* are cut off along a cutting line CL. After the contacts 6 and 7 are changed to new ones, the cover 3 is attached to the switch 1, the member 17 is fixed by the terminal 5 on the cover 3, and the connecting portion 17*g* is turned back so as to surround the root portion 16*a*. Thereafter, the connecting portion 17*g* and the root portion 16*a* are joined or bonded together with solder.

Accordingly, in the same manner as in the first embodiment, cost required in the maintenance can be reduced, and the maintenance of the switch 1 can be easily performed.

In the first and second embodiments, the member 17 has two connecting portions. However, the member 17 may have three connecting portions or more. Because one connecting portion is removed from the member 17 every maintenance of the switch 1, the maintenance requiring the detachment and attachment of the cover 3 from and to the switch 1 can be performed many times.

Further, the connecting portion 17*g* of the member 17 not joined to the terminal 16 is in contact with the terminal 16. However, the connecting portion 17*g* may be disposed to be away from the terminal 16 while the connecting portion 17*f* is joined to the terminal 16.

Moreover, the connecting portion 17*f* joined to the terminal 16 is turned back so as to surround the terminal 16. However, the connecting portion 17*f* joined to the terminal 16 may be straightly extended not to surround the terminal 16.

Furthermore, the connecting portions 17*f* and 17*g* are disposed so as to be separated from each other through the opening 17*e*. However, the member 17 may have a single connecting portion not having an opening but have a wide width along an extending direction of the terminal 16. In this case, only a part of the connecting portion nearest to the top of the terminal is joined to the terminal 6 with solder. When the maintenance of the switch 1 is performed, the part of the connecting portion is cut off, and the other part of the connecting portion is joined to the terminal.

Embodiment 3

Figure 10:
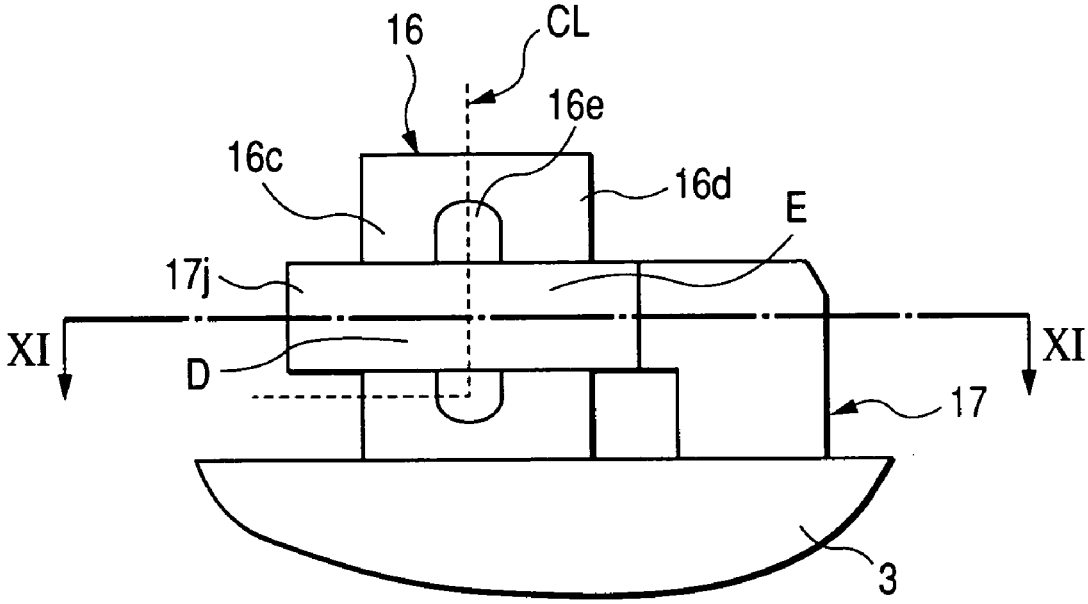
FIG. 10 is a side view of both a terminal and a conductive plate joined together according to a third embodiment.
Figure 11:
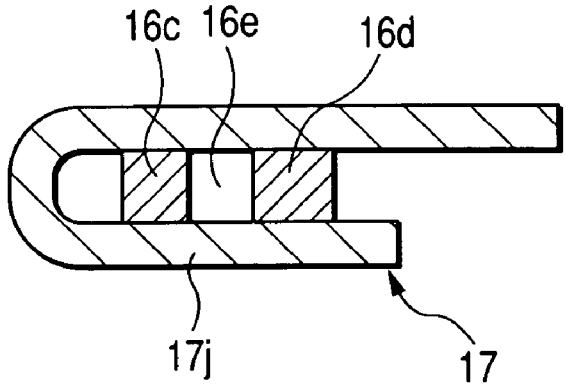
FIG. 11 is a sectional view taken substantially along line XI-XI of FIG. 10.

FIG. 10 is a side view of both a terminal and a conductive plate joined together according to the third embodiment, and FIG. 11 is a sectional view taken substantially along line XI-XI of FIG. 10.

As shown in FIGS. 10 and 11, the second end portion of the terminal 16 has a first divided portion 16*c* and a second divided portion 16*d* facing each other along a width direction of the terminal 16 through a long and narrow opening 16*e* extending along a longitudinal direction of the terminal 16. The conducting member 17 has a connecting arm 17*j* extending from the portion 17*c*. The arm 17*j* is extended along the width direction of the terminal 16 and is turned back so as to surround the divided portions 16*c* and 16*d*. The divided portion 16*c* of the terminal 16 and a portion of the arm 17*j* being in contact with the portion 16*c* are joined bonded together in a joinable area D with solder or the like. In this case, a portion of the arm 17*j* being in contact with the divided portion 16*d* of the terminal 16 is not joined to the divided portion 16*d*. Therefore, a joinable area E of the arm 17*j* and the divided portion 16*d* remains as a non-joined area.

In the normal maintenance of the switch 1, the divided portion 16*c* of the terminal 16 and the portion of the arm 17*j* joined together are cut off along a cutting line CL and is removed from the switch 1. After the maintenance, the joinable area E of the arm 17*j* and the divided portion 16*d* are joined together with solder or the like.

Accordingly, in the same manner as in the first embodiment, cost required in the maintenance of the switch 1 can be reduced, and the maintenance can be easily performed.

In this embodiment, the conducting member 17 may have the arm 17*d* with the portions 17*f* and 17*g*. In this case, there are four joinable areas.

What is claimed is:

1. An electromagnetic switch, comprising:

a solenoid having an electromagnetic coil which receives an electric current to cause the electromagnetic coil to act as an electromagnet, and generates an attraction force by using the electromagnet;

an electric contact section which is set to a closed state in response to the attraction force to transmit electric power through the electric contact section;

a contact cover which is fitted to the solenoid and with which the electric contact section is covered;

a terminal which is an end portion of the electromagnetic coil and is placed within the contact cover, an end portion of the terminal being protruded from the contact cover; and a conducting member electrically connected with the end portion of the terminal, wherein the conducting member has a plurality of connecting portions, one of the connecting portions of the conducting member is bonded to the end portion of the terminal, and at least one of the other connecting portions of the conducting member is spaced from or in contact with but not bonded to the terminal.

2. The switch according to claim 1, wherein the at least one of the other connecting portions of the conducting member is spaced from or in contact with but not bonded to the terminal even in a condition that the connecting portion of the conducting member bonded to the end portion of the terminal is removed from the conducting member.

3. The switch according to claim 1, wherein positions of the other connecting portions of the conducting member are nearer to the contact cover than a position of the connecting portion of the conducting member bonded to the end portion of the terminal.

4. The switch according to claim 1, wherein the at least one of the connecting portions of the conducting member is in contact with but not bonded to the end portion of the terminal.

5. The switch according to claim 1, wherein the contact cover, the terminal and the conducting member are disposed such that one of the other connecting portions of the conducting member is bonded to the end portion of the terminal after the connecting portion of the conducting member bonded to the end portion of the terminal is removed from the conducting member to detach the contact cover from the solenoid and to fit the contact cover detached from the solenoid to the solenoid while placing the terminal within the contact cover.

6. An electromagnetic switch, comprising:

a solenoid having an electromagnetic coil which receives an electric current to cause the electromagnetic coil to act as an electromagnet, and generates an attraction force by using the electromagnet;

an electric contact section which is set to a closed state in response to the attraction force to transmit electric power through the electric contact section;

a contact cover which is fitted to the solenoid and with which the electric contact section is covered;

a terminal which is an end portion of the electromagnetic coil and is placed within the contact cover, an end portion of the terminal being protruded from the contact cover; and a conducting member electrically connected with the end portion of the terminal, wherein the end portion of the terminal has a plurality of divided portions, the conducting member is bonded to one of the divided portions of the terminal, and the conducting member is spaced from or in contact with but not bonded to at least one of the other divided portions of the terminal.

7. The switch according to claim 1, wherein the one of the connecting portions of the conducting member is bonded to the end portion of the terminal with solder or by welding.

8. The switch according to claim 6, wherein the conducting member is bonded to the one of the divided portions of the terminal with solder or by welding.

* * * * *